US008899154B2

(12) United States Patent
Dyk

(10) Patent No.: US 8,899,154 B2
(45) Date of Patent: Dec. 2, 2014

(54) ROCK BREAKING

(75) Inventor: Andre V. Dyk, Centurion (ZA)

(73) Assignee: Green Break Technology Limited, Jersey (GB)

( * ) Notice: Subject to any disclaimer, the term of this patent is extended or adjusted under 35 U.S.C. 154(b) by 0 days.

(21) Appl. No.: 13/348,409

(22) Filed: Jan. 11, 2012

(65) Prior Publication Data

US 2012/0180683 A1 Jul. 19, 2012

(30) Foreign Application Priority Data

Jan. 11, 2011 (GB) ..... 1100424.9

(51) Int. Cl.

| | |
|---|---|
| ***F42B 3/10*** | (2006.01) |
| ***F42B 3/00*** | (2006.01) |
| ***F42D 3/04*** | (2006.01) |
| ***F42B 3/02*** | (2006.01) |

(52) U.S. Cl.

CPC .... *F42B 3/02* (2013.01); *F42D 3/04* (2013.01)
USPC ..... 102/317; 102/313; 102/319; 102/320; 102/322; 102/331

(58) Field of Classification Search

USPC ..... 102/313, 314, 317, 319, 320, 321, 322, 102/331; 299/13
See application file for complete search history.

(56) References Cited

U.S. PATENT DOCUMENTS

| | | | | |
|---|---|---|---|---|
| 3,307,445 | A | | 3/1967 | Stadler et al. |
| 4,637,849 | A | | 1/1987 | Harris, Jr. |
| 4,900,092 | A | * | 2/1990 | Van Der Westhuizen et al. ..... 299/13 |
| 5,670,737 | A | * | 9/1997 | Mey ..... 102/302 |
| 5,765,923 | A | | 6/1998 | Watson et al. |
| 2010/0089270 | A1 | | 4/2010 | Mattson |

FOREIGN PATENT DOCUMENTS

| | | | |
|---|---|---|---|
| WO | WO-00/31495 | A1 | 6/2000 |
| WO | WO-2009/120139 | A1 | 10/2009 |

OTHER PUBLICATIONS

Written Opinion of the International Searching Authority for PCT/IB2012/050098; Nov. 2013.*

* cited by examiner

*Primary Examiner* — James Bergin
(74) *Attorney, Agent, or Firm* — Novak Druce Connolly Bove + Quigg LLP

(57) ABSTRACT

An auxiliary cartridge for use in rock breaking is disclosed which comprises an elongate body, an end closure at each end of the body and a charge of combustible material in the space defined by the body and the end closures. One of the end closures includes a frangible membrane which closes off a charge of combustible chemicals. On being subjected to the pressure of an external ignition of fast burning combustible material, the membrane fails and permits flame to flash through it from externally of the auxiliary cartridge to internally thereof thereby to ignite said charge.

16 Claims, 6 Drawing Sheets

ROCK BREAKING

CROSS REFERENCE TO RELATED APPLICATIONS

This application claims priority to United Kingdom Application No. 1100424.9, filed Jan. 11, 2011. The entire contents of which are incorporated herein by reference.

FIELD OF THE INVENTION

THIS INVENTION relates to rock breaking.

BACKGROUND TO THE INVENTION

Non-explosive rock breaking is well established. A cartridge containing a charge of combustible material is inserted into a drilled hole in the rock, the hole is sealed using sand (a process called "stemming" in the industry) and the charge ignited. A high volume of a harmless gas is produced which has the effect of splitting the rock.

The same technique is used for breaking up man-made concrete structures and the term "rock breaking" as used herein is to be construed as including the breaking of both naturally occurring rock and man-made structures with rock-like characteristics.

One commercially available cartridge is known as the "NONEX" cartridge. Nonex cartridges are supplied in a wide range of sizes (both in length, in diameter and in charge size) and substantial numbers must be purchased and held in stock to ensure that all rock breaking situations that arise can be dealt with.

It is possible to use a number of Nonex cartridges simultaneously by suitably wiring them to the firing circuit. However, a practical difficulty is that the cartridges ignite in sequence and the first cartridges to ignite can sever the wires to the cartridges which are to fire later, with the result that some cartridges do not fire. This means that difficulties are encountered in clearing the broken rock as it has live cartridges buried in it.

A further commercially available system is known as the "Boulder Buster". This can only be used in a vertically drilled hole. A number of cartridges are dropped into the hole and the hole is then water filled. The uppermost cartridge is ignited and the downward pressure on the cartridges below ignites them in sequence. Each cartridge includes a pressure activated cap.

U.S. Pat. Nos. 4,900,092 and 5,670,737 describe such cartridges.

The present invention provides a rock breaking system which has advantages over the two known systems described above.

BRIEF DESCRIPTION OF THE INVENTION

According to a first aspect of the present invention there is provided a rock breaking cartridge comprising an elongate tubular body, an end closure at each end of the body, a charge of combustible material in the body and means for igniting the charge, characterised in that one of said end closures permits flame to flash through it on ignition of said charge.

In the preferred form for said one of said end closures includes a frangible membrane, which upon ignition of said charge, fails and permits flame to flash though it.

Said one of said end closures preferably has a blind bore in it, the end of said blind bore remote from the charge being open and said frangible membrane closing the end of said blind bore which is adjacent said charge. The surface of said blind bore can have a circumferentially extending groove in the surface thereof.

A plug of waterproofing gel can be provided in the blind bore adjacent said membrane.

To secure the cartridge in the drilled hole, locking elements can be provided which protrude radially outwardly beyond the outer surface of the tubular body and which are configured to bend over as they encounter the entrance to a borehole during insertion of the cartridge into the borehole.

Said locking elements can be constituted by an outwardly directed flange with gaps in it.

According to a second aspect of the present invention there is provided an auxiliary rock breaking cartridge which comprises an elongate body, an end closure at each end of the body and a charge of combustible material in the space defined by the tubular body and the end closures, characterised in that one of said end closures comprises a body having a bore in it which is closed at its outer end by a frangible membrane, the bore being filled with propellant and the end of the bore remote from said membrane communicating with said space.

Said one end closure can include an external circumferentially extending locking rib which encircles said body.

In the preferred form the other end closure of the auxiliary cartridge has a blind bore in it, the end of said blind bore remote from the charge being open and there being a frangible membrane at the end of said blind bore which is adjacent said charge.

According to a third aspect of the present invention there is provided, in combination:— a rock breaking cartridge comprising an elongate body, an end closure at each end of the body and a charge of combustible material in the space bounded by said body and said end closures; and an ignition module comprising a body, a propellant charge in a cavity of the body of the ignition module, one part of the bounding wall of the cavity being constituted by a frangible membrane, and means for igniting the propellant charge;

at least one of said end closures and said module including interengagable interlocking means for securing the ignition module to the rock breaking cartridge with said frangible membrane so positioned that, upon it failing when said propellant charge is ignited, flame flashes through it into said space of the rock breaking cartridge and ignites the charge in said space.

According to a fourth aspect of the present invention there is provided the combination of:— a rock breaking cartridge comprising an elongate body, an end closure at each end of the body, a charge of combustible material in the body and means for igniting the charge; and an auxiliary cartridge comprising an elongate body, an end closure at each end of the body and a charge of combustible material in the space defined by the tubular body;

the cartridges including means for connecting them to one another, the end closures which are adjacent to one another after connection permitting flame to flash through them on ignition of the charge of the rock breaking cartridge thereby to ignite the charge of the auxiliary cartridge.

According to a fifth aspect of the present invention there is provided, in combination:— a rock breaking cartridge comprising an elongate body, an end closure at each end of the body and a charge of combustible material in the space bounded by said body and said end closures; and an ignition module comprising a body, a propellant charge in a cavity of the body of the ignition module, and means for igniting said charge;

said module and at least one of said end closures including interlockable means for securing the module to the cartridge;

ignition of the propellant charge of the module causing flame to flash through into the said space in the cartridge to ignite the charge in said space.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 1:
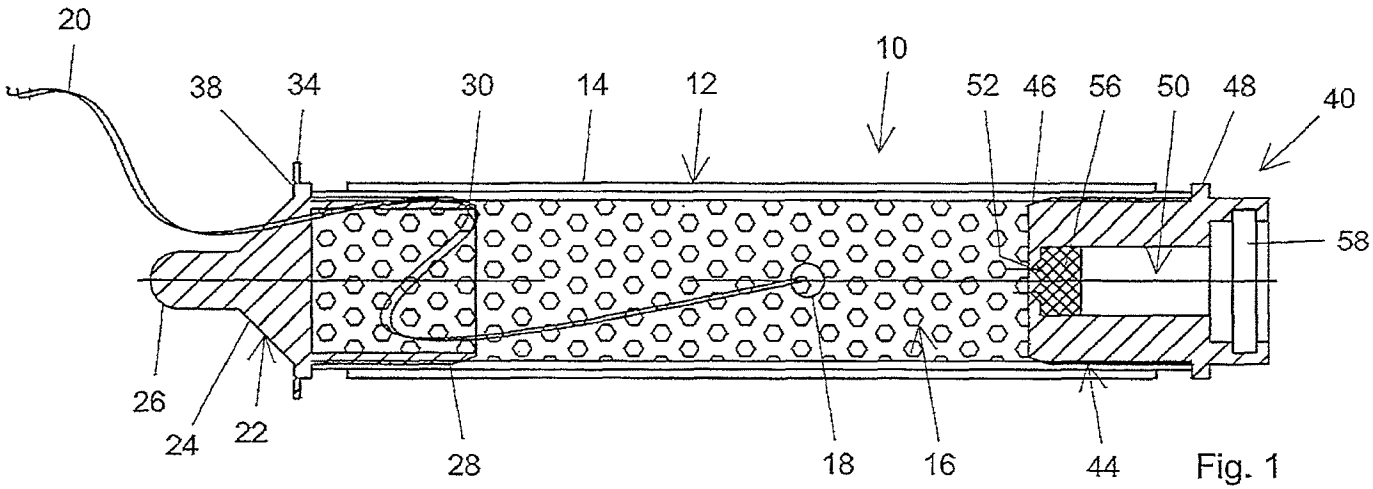
FIG. 1 is a diagrammatic axial section through a rock breaking cartridge.
Figure 3:
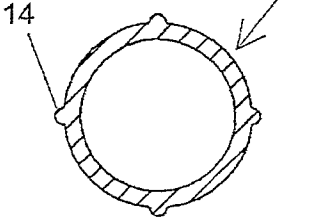
FIG. 3 is a section through the tubular body of FIG. 2.
Figure 2:
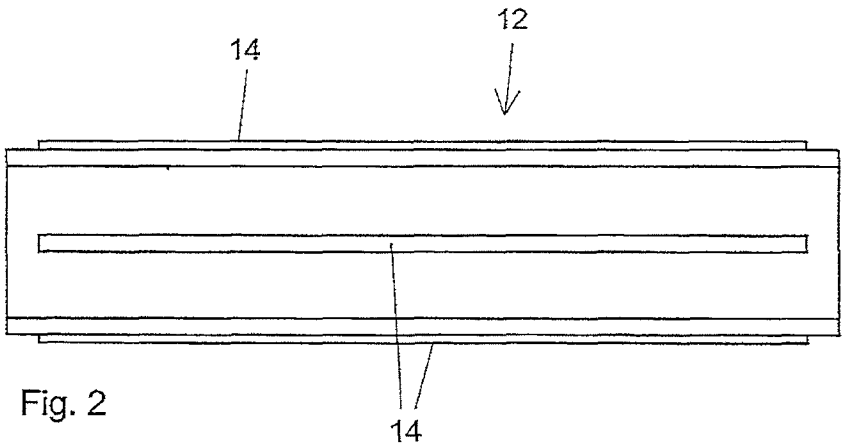
FIG. 2 is a side elevation of the tubular body of the cartridge of FIG. 1.

The rock breaking cartridge 10 illustrated in FIG. 1 comprises a tubular body 12 which is preferably a synthetic plastics material injection moulding. The synthetic plastics material can be a polymer or a co-polymer. Externally the body has four axially extending ribs 14 which are equally spaced around the tubular body 12. The number of ribs 14 can be varied and five or six equally spaced ribs can be provided. The ribs terminate short of each end of the body 12. The body 12 is filled with a combustible chemical charge designated 16 which is mixed with an oxidiser. A suitable combustible chemical is a nitrocellulose propellant and a suitable oxidiser is ammonium nitrate.

Embedded in the charge 16 is a fuse ahead 18 connected by wires 20 to an external source of electricity (not shown) which serves to ignite the fuse head 18 and hence the charge 16.

Figure 5:
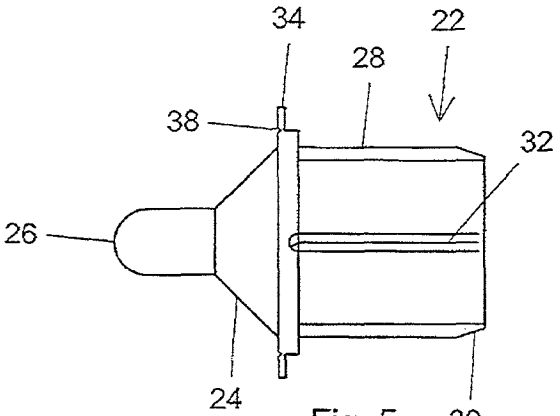
FIG. 5 is a side elevation of the end closure of FIG. 4.
Figure 6:
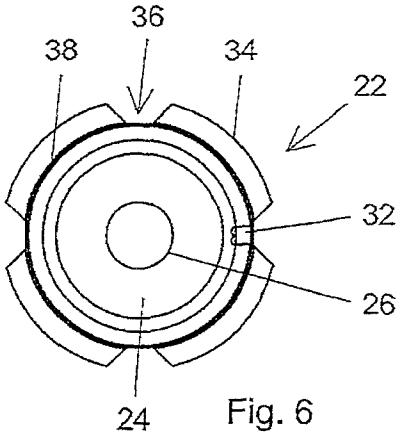
FIG. 6 is a front elevation of the end closure of FIGS. 4 and 5.

An end closure 22 (see FIGS. 5, 6 and 7) is fitted into one end of the tubular body 12. The end closure 22 is an injection moulding and comprises a frustoconical main portion 24 with a probe 26 protruding from the portion 24. The probe 26 has an end surface which is hemispherical in shape. On the opposite side of the main portion 24 to the probe 26 there is a sleeve 28 the free end of which is chamfered at 30 to facilitate its insertion into the tubular body 12. A groove 32 extends along the sleeve 28 and through the main portion 24.

Figure 7:
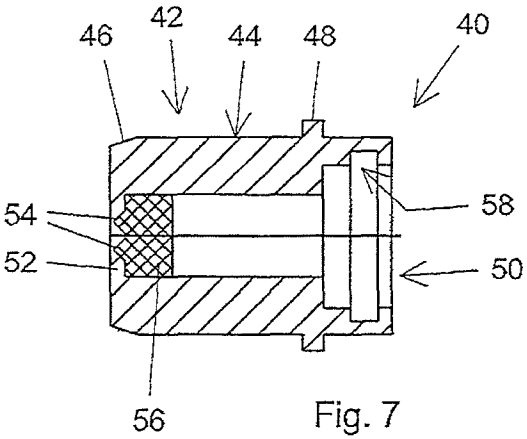
FIG. 7 is a diagrammatic axial section through the other of the end closures of the cartridge of FIG. 1.

The main portion 24 is encircled by a flexible flange 34. As best seen in FIG. 7, the flange 34 is not continuous but has gaps 36 in it thereby providing for circumferentially elongate fingers which protrude outwardly from the remainder of the end closure 22. The flange 34 includes a film hinge at 38, this facilitating bending over of the four locking fingers which constitute the flange 34 as will be described below. As the end closure 22 is fitted to the tubular body 12, the wires 20 are pressed into the groove 32 which consequently forms the passageway permitting the wires to emerge from the cartridge.

A further end closure 40 is shown in FIG. 7, this being fitted into the other end of the tubular body 12. The body 42 of the end closure 40 comprises a cylindrical portion 44 the front end of which is chamfered at 46 to facilitate its insertion into the tubular body 12. A flange 48 of larger diameter than the portion 44 encircles the portion 44. The closure has a blind axial bore 50 in it. The closed end of the bore 50 is constituted by a membrane 52. The membrane includes a circular groove 54 thereby to provide a circular line of weakening.

A plug of water repellent gel 56 is provided in the bore 50 adjacent to the membrane 52.

Close to its open end the bounding wall of the bore 50 is stepped to provide a circumferentially extending internal groove 58.

Figure 8:
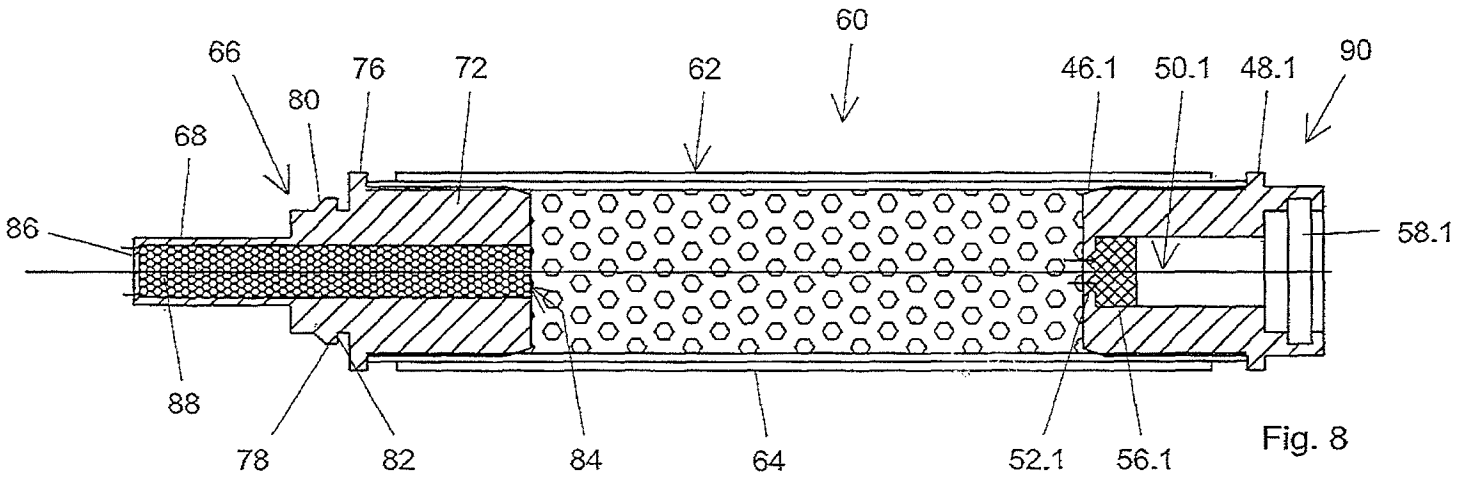
FIG. 8 is an axial section through an auxiliary cartridge.

An auxiliary cartridge is shown in FIG. 8 and is designated 60. The cartridge 60 comprises a tubular body 62 with external ribs 64 and in which there is a charge of combustible chemical.

One end of the body 62 is closed by an end closure 66. The end closure 66 is configured so that it fits into the end closure 40 (FIGS. 1 and 7) of the cartridge 10. More specifically the end closure 66 comprises an elongate sleeve 68 (see particularly FIG. 9) which protrudes from a cylindrical body 70. The body 70 includes a larger diameter part 72 and a smaller diameter part 74. A flange 76 encircles the body 70 between the parts and a circumferentially extending rib 78 encircles the smaller diameter part 74. The rib 78 has a front face which is chamfered at 80. This facilitates its insertion into the groove 58 of the end closure 40. The rear face 82 of the rib 78 lies in a diametrical plane.

A bore 84 passes through the body 70 and through the sleeve 68. The end of the part of the bore 84 in the sleeve 68 is closed by a frangible membrane 86. The membrane 86 is integral with the sleeve 68 and the outer periphery of the membrane is constituted by a thin circular section which promotes failure of the membrane under pressure. The entire length of the bore 84 is filled with a fast burning propellant charge 88.

The closure 90 (see FIG. 8) at the other end of the tubular body 62 of the auxiliary cartridge 60 is identical to the end closure 40 of the main cartridge 10. Where applicable, like parts are designated with the same numerals to which the suffix .1 has been added.

The weight of the charge in the cartridge 10 is, simply by way of example, between 20 and 1000 g. It can be more than this or less than this but this range is accepted by the industry as providing suitable effects when ignited.

Figure 10:
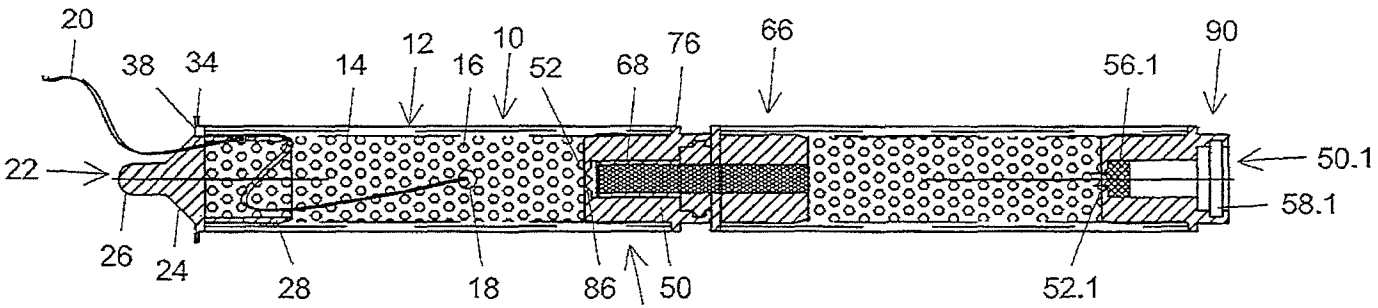
FIG. 10 is an axial section illustrating the auxiliary cartridge of FIG. 8 fitted to the rock breaking cartridge of FIG. 1.

In a specific circumstance it might be decided that the quantity of the charge 16 is too small for the intended purpose. In these circumstances an auxiliary cartridge 60 is secured to the main cartridge 10 as shown in FIG. 10. The sleeve 68 is inserted into the blind bore 50 of the end closure 40 until the membrane 86 is adjacent the membrane 52. The two membranes are not in contact as some of the water repellent gel 56 is between them. As the leading end of the sleeve 68 presses into the gel 56 some of it is displaced into the narrow annular gap between the outer surface of the sleeve 68 and the bounding surface of the bore 50. Insertion of the auxiliary cartridge 60 into the rock breaking cartridge 10 is limited by the flange 76 which abuts the end of the tubular body 62. The rib 78 enters the groove 58. The construction is such that the membranes 86 and 52 are spaced apart when the cartridges are fully interlocked. Engagement between the face 82 and the surface of the groove 58 prevents the two cartridges thereafter being separated.

The two cartridges 10, 60 are then pushed into the drilled hole in the rock or concrete structure to be broken. The fingers constituting the flange 34 bend back during insertion of the cartridge 10 into the bore. Any attempt to pull the cartridges 10, 60 out of the bore is resisted by the fingers which catch on the uneven surface of the bore.

When the charge 16 is ignited by the fuse head 18, the tubular body 12 expands outwardly. The ribs 14 contact the surface of the bore and there are consequently four intense lines of force which are exerted on the rock or concrete structure.

The membrane 52, when subjected to the high pressure of the burning charge 16, bursts through and consequently the membrane 86 which seals the end of the sleeve 68 is subjected to the high pressure of the burning charge 16. The membrane 86 itself fails and the flame which has flashed through the two membranes ignites the propellant charge 88 in the auxiliary cartridge 60. The flame from the charge 88 spurts into the main charge of the cartridge 60.

Figure 11:
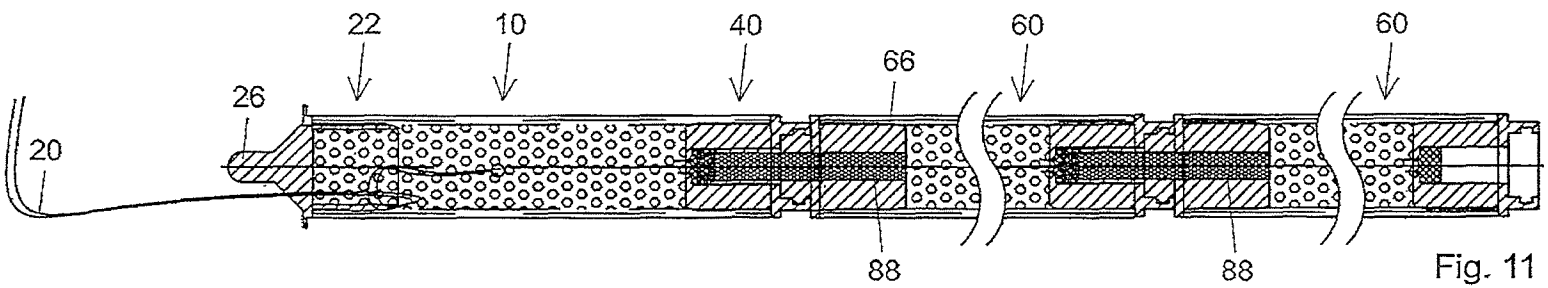
FIG. 11 is an axial section illustrating the rock breaking cartridge of FIG. 1 with two auxiliary cartridges fitted to it.

As shown in FIG. 11, a first auxiliary cartridge 60 can be attached to the rock breaking cartridge 10 and then a second auxiliary cartridge 60 can be attached to the first auxiliary cartridge 60 thereby to increase the length of the bore which is subjected to the effects of the burning charges.

The bodies 12 and 62 can have some flexibility so that they can distort should the bore into which they are being pushed not be entirely straight.

It is also possible for the bodies, externally, to be coated with a fluorescent material so that they are more readily manipulated in the darkness of an underground mine.

Figure 12:
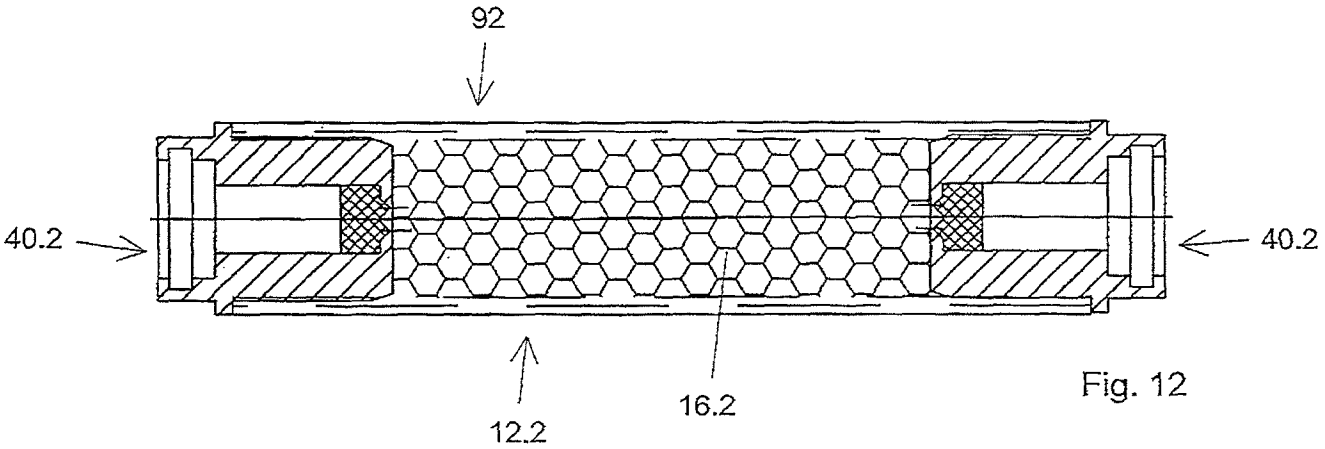
FIG. 12 is an axial section through a further form of rock breaking cartridge.

The cartridge of FIG. 12 is designated 92 and has parts in common with the cartridge of FIG. 1. Where applicable like parts have been designated with like references to which the suffix 2 has been added.

The end closures of the cartridge 92 of FIG. 12 are identical to one another and are of the same construction as the end closure 40 (FIG. 7).

Figure 9:
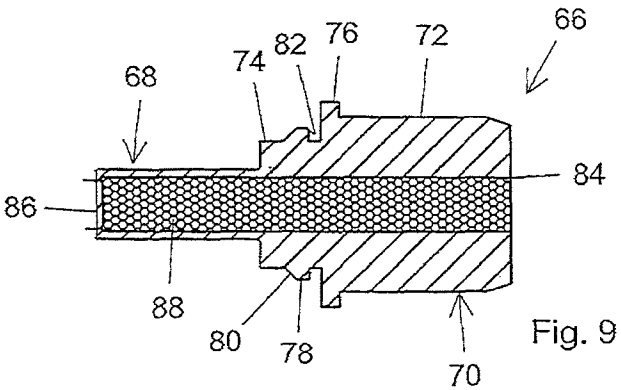
FIG. 9 is an axial section illustrating an end closure of the auxiliary cartridge of FIG. 8.
Figure 13:
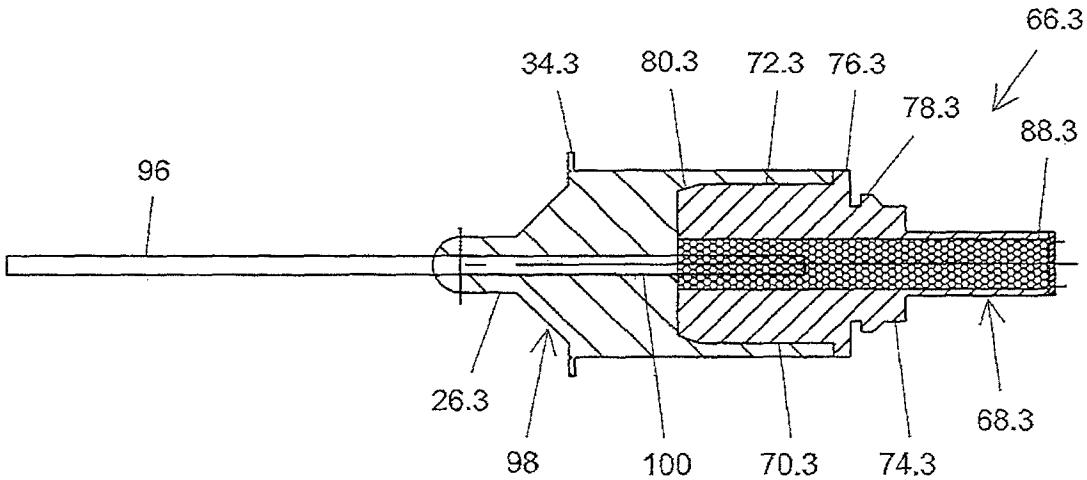
FIGS. 13 to 15 are axial sections through ignition modules.

The module 94 illustrated in FIG. 13 is of the same construction as the end closure 66 illustrated in FIG. 9. Where applicable like parts have been designated with the same reference numerals to which the suffix 3 has been added. The module 94 can plug into either end closure 40.2 of the cartridge 92.

An ignition system 96 of known form penetrates the membrane 86.2 and terminates in the propellant charge 88.3. The ignition system can be a shock tube ignition system or one including an optic fibre for laser ignition.

Figure 4:
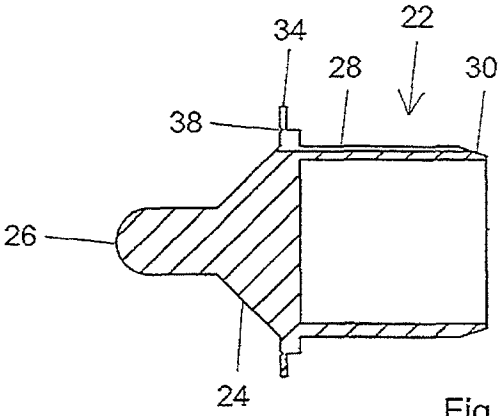
FIG. 4 is an axial section through one of the end closures of the cartridge of FIG. 1.

A closure cap 98 fits onto the body 70.3 of the module 94. The closure cap 98 can be configured in the same way as the end closure 22 (FIGS. 4, 5 and 6) and have a probe 26.3 equivalent to the probe 26 so that it can co-operate with the stemming tool to be described. The cap 98 also has a flange 34.3. The ignition system 98 passes through a bore 100 in the closure cap 98.

Figure 14:
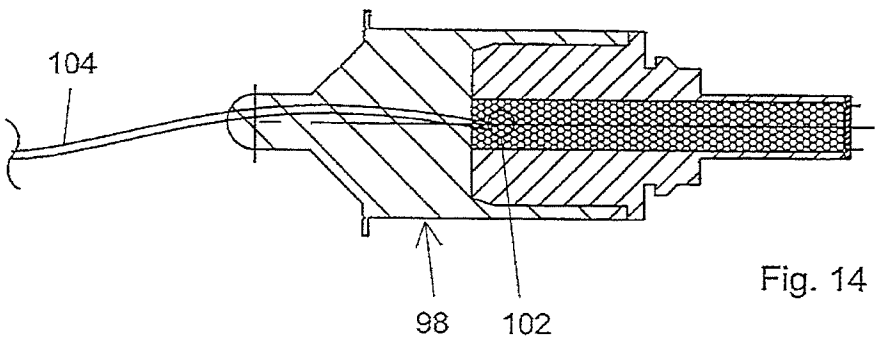

In FIG. 14 the ignition system comprises a fuse head 102 to which electrical wires 104 are connected.

Figure 15:
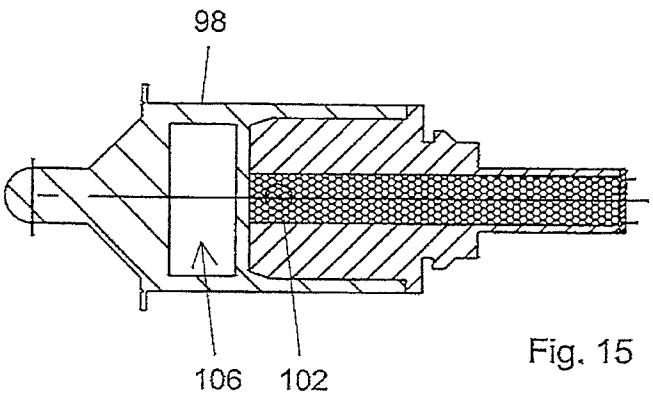

In FIG. 15 the closure cap 98 includes a programmable electronic ignition system 108 with wireless communication abilities so that programming and ignition can be undertaken remotely via, for example, blue tooth. The ignition system 108 is encapsulated and then moulded into the cap 98.

In all the constructions described above there are grooves such as 58 and 58.1 which receive the ribs such as 78 and 78.3.

In a modified form, which has not been illustrated, the grooves are replaced by diametrically opposed openings in the portion 44. These openings form recesses which open into the bore. At positions at right angles to the positions of the openings there are opposed internal flats.

The ribs, such as the ribs 78, are in this form replaced by two diametrically opposed locking elements which distort as two cartridges are interlocked and then snap into the opposed recesses. There can be external flats which match the internal flats so that the two cartridges have to be correctly orientated before a modified end closure 66 can enter a modified end closure 40.

The bore 50 can itself be the bore of a central tube which extends axially of the closure 40 and which is connected to the portion 44 by vanes each of which lies in a radial plane.

The invention claimed is:

1. A rock breaking non-detonation type cartridge comprising:

an elongate tubular body having a front end and a rear end, an end closure at each end of the body, the end closure at the rear end of the body having a blind bore terminating in a rear membrane;

a charge of non-detonation type combustible material in the body, and an igniter configured to ignite the charge, wherein the rear membrane permits flame entering the blind bore to flash through the rear membrane;

wherein the cartridge directs flame from combustion of the combustible material out the front end.

2. A rock breaking cartridge as claimed in claim 1, characterised in that there is a circumferentially extending groove in the surface of said membrane.

3. In combination, the rock breaking cartridge of claim 2 and an auxiliary cartridge which comprises an elongate body, an end closure at each end of the body and a charge of combustible material in the space defined by the tubular body and the end closures, characterised in that one of said end closures comprises a body having a bore in it which is closed at its outer end by a frangible membrane, the bore being filled with propellant and the end of the bore remote from said membrane communicating with said space, wherein said one end closure includes an external circumferentially extending locking rib which encircles said body and wherein said frangible membrane of the auxiliary cartridge is adjacent the frangible membrane of the rock breaking cartridge whereby, on ignition, failure of the membrane of the rock breaking cartridge subjects the membrane of the auxiliary cartridge to the pressure of the burning gases thereby to cause the membrane of the auxiliary cartridge to fail and ignite, in sequence, the propellant and the charge of the auxiliary cartridge, said locking rib of the auxiliary cartridge being in the groove of the rock breaking cartridge thereby to lock the two cartridges together.

4. A rock breaking cartridge as claimed in claim 1, and including recesses in said one end closure which recesses open into said blind bore.

5. In combination the rock breaking cartridge of claim 4 and an auxiliary cartridge which comprises an elongate body, an end closure at each end of the body and a charge of combustible material in the space defined by the tubular body and the end closures, characterised in that one of said end closures comprises a body having a bore in it which is closed at its outer end by a frangible membrane, the bore being filled with propellant and the end of the bore remote from said membrane communicating with said space, said one end closure includes latch elements which extend outwardly from said body and wherein said frangible membrane of the auxiliary cartridge is adjacent the frangible membrane of the rock breaking cartridge whereby, on ignition, failure of the membrane of the rock breaking cartridge subjects the membrane of the auxiliary cartridge to the pressure of the burning gases thereby to cause the membrane of the auxiliary cartridge to fail and ignite, in sequence, the propellant and the charge of the auxiliary cartridge, said latch elements of the auxiliary cartridge being in said recesses of the rock breaking cartridge thereby to lock the two cartridges together.

6. A rock breaking cartridge as claimed in claim 1 wherein there is a plug of waterproofing gel in the blind bore adjacent and on a rear side of said rear membrane.

7. A rock breaking cartridge as claimed in claim 1 and including locking elements which protrude radially outwardly beyond the outer surface of the tubular body and which are configured to bend over as they encounter the entrance to a borehole during insertion of the cartridge into the borehole.

8. A rock breaking cartridge as claimed in claim 7, wherein the other end closure includes an outwardly directed flange with gaps in it, the portions of the flange between said gaps constituting said locking elements.

9. A rock breaking cartridge as claimed in claim 1, wherein said elongate tubular body has axially extending external ribs.

10. In combination a rock breaking cartridge as claimed in claim 1 and an auxiliary cartridge which comprises an elongate body, an end closure at each end of the body and a charge of combustible material in the space defined by the tubular body and the end closures, characterised in that one of said end closures comprises a body having a bore in it which is closed at its outer end by a frangible membrane, the bore being filled with propellant and the end of the bore remote from said membrane communicating with said space, wherein the other end closure of the auxiliary cartridge has a blind bore in it, the end of said blind bore remote from the charge being open and there being a frangible membrane at the end of said blind bore which is adjacent said charge and wherein said frangible membrane of the auxiliary cartridge is adjacent the frangible membrane of the rock breaking cartridge whereby, on ignition of the charge of the rock breaking cartridge, failure of the membrane of the rock breaking cartridge subjects the membrane of the auxiliary cartridge to the pressure of the burning gases thereby to burst the membrane of the auxiliary cartridge and ignite in sequence the propellant and the charge of the auxiliary cartridge.

11. The combination of claim 10, wherein said one end closure of the rock breaking cartridge has a blind bore in it, said frangible membrane of the rock breaking cartridge forming the closure at the blind end of said bore.

12. The combination of claim 11, wherein there is a plug of waterproofing gel in the blind bore adjacent the membrane of the rock breaking cartridge.

13. The combination of claim 10, characterised in that the other end closure of the auxiliary cartridge includes a frangible membrane which, upon ignition of the charge of the auxiliary cartridge, fails and permits flame to flash through it.

14. The cartridge of claim 1, wherein the igniter comprises an electrically activated fuse connected to the charge.

15. The cartridge of claim 1, wherein the rear membrane is a frangible membrane.

16. The cartridge of claim 1, wherein the end closure at the front end of the body has a front frangible membrane configured to fail under pressure from combustion of the combustible material to thereby allow flame produced by the combustion to exit the front end of the body.

* * * * *